US005975713A

United States Patent [19]

Brothers

[11] Patent Number: 5,975,713

[45] Date of Patent: Nov. 2, 1999

[54] INTERIOR MAILBOX LIGHT

[76] Inventor: Harlan Jay Brothers, 103 Island View Ter., Branford, Conn. 06405

[21] Appl. No.: 08/672,310

[22] Filed: Jun. 28, 1996

Related U.S. Application Data

[63] Continuation of application No. 08/378,959, Jan. 27, 1995, abandoned.

[51] Int. Cl.[6] ..... F21V 33/00

[52] U.S. Cl. ..... 362/155; 362/154; 362/802

[58] Field of Search ..... 362/154, 155, 362/156, 190, 191, 398, 802, 276; 232/13, 17, 25

[56] References Cited

U.S. PATENT DOCUMENTS

| | | | |
|---|---|---|---|
| 1,819,398 | 8/1931 | Wegehoft | 362/154 |
| 1,842,597 | 1/1932 | Foti | 362/154 |
| 2,240,462 | 4/1941 | Rocheleau | 362/155 |
| 2,411,100 | 11/1946 | MacDonald | 362/155 |
| 2,772,349 | 11/1956 | Chamberlin | 362/191 |
| 4,154,393 | 5/1979 | Darvishian | 232/36 |
| 4,648,012 | 3/1987 | Pittman, II | 362/155 |
| 4,755,915 | 7/1988 | Rogers | 362/155 |
| 4,860,949 | 8/1989 | Moore | 232/35 |
| 4,872,095 | 10/1989 | Dubak et al. | 362/802 |

*Primary Examiner*—Y My Quach
*Attorney, Agent, or Firm*—Robert L. Tucker

[57] ABSTRACT

In a mailbox having walls that define an interior space and a door which allows access to the interior space, an apparatus for illuminating the interior of the mailbox comprises a housing adapted to be affixed to the interior of the mailbox, the housing including an illumination source; a mount to affix the housing to the interior of the mailbox; a magnetic switch in operative engagement with the illumination source to light the illumination source, the switch operating in an off state and an on state; and, a magnet, affixed to the door, which moves between a first position and a second position so as to determine the state of the magnetic switch.

19 Claims, 3 Drawing Sheets

INTERIOR MAILBOX LIGHT

RELATED APPLICATION

This is a continuation of application Ser. No. 08/378,959 filed on Jan. 27, 1995, now abandoned.

BACKGROUND OF THE INVENTION

1. Field of the Invention

The present invention relates to mailboxes and in particular to the interior lighting of mailboxes.

2. Description of the Prior Art

Although mail is generally delivered during daylight hours, it is often collected from the mailbox by the recipient during the evening hours when there is little or no ambient light. Even when it is clear that there is mail in the box, under low light conditions visual inspection does not easily reveal whether some of the mail has slid to the rear of the box, out of immediate reach. Typically, a person must then reach in and feel by hand for the presence of additional parcels or envelopes. In addition to the inconvenience and uncertainty associated with feeling by hand for the mail, many people, indeed, have a fear of sticking their hands into unlit places.

Though there have been previous attempts to supply light to the inside of a mailbox, all have problems with ease of installation, ease of service, and/or other limitations. For example, U.S. Pat. No. 4,154,393 requires power from inside the home. U.S. Pat. No. 4,648,012 requires the threading of wire through the box itself, will only work in conjunction with metal mailboxes, and requires the user to push a button in order to activate the light.

SUMMARY OF THE INVENTION

Accordingly, it is an object of the present invention to provide an interior mailbox light which can be quickly and easily installed by the user.

Another object is to provide such a mailbox light that is compatible with a variety of different mailbox designs and configurations.

A further object is to provide such a mailbox light that is reliable and easy to service.

It is also an object to provide such a mailbox light that operates without special action or attention on the part of the user.

It is another object to provide such a mailbox light that is efficiently designed and inexpensive to manufacture.

It has been found that the above and other objects of the present invention are attained in an interior mailbox light comprising a housing adapted to be affixed to the interior of a mailbox, the housing including an illumination source; and, a switch to light the illumination source, the switch operating in an off state and an on state.

Preferably, the switch is a magnetic switch.

In a preferred embodiment, a magnet moves between a first position and a second position so as to determine the state of the magnetic switch.

In a preferred embodiment, the housing includes a mount to affix the housing to the interior of the mailbox. Preferably, the mount is detachable. Preferably, the mount is magnetically detachable.

In a preferred embodiment, the illumination source includes a reflector. Preferably the illumination source includes a lens.

In a preferred embodiment, the interior mailbox light employs a magnetic switch which functions in a normally closed mode, although alternatively it can employ a magnetic switch which functions in a normally open mode.

In a preferred embodiment, the magnet is mounted to the door of the mailbox. Preferably, it is disposed, when the door is in a substantially closed position, so as to be in effective proximity to the magnetic switch, rendering the magnetic switch in the off state. Alternatively, it can be disposed, when the door is in a substantially open position, so as to be in effective proximity to the magnetic switch, rendering the magnetic switch in the on state.

In an alternative embodiment, an internally lighted mailbox comprises an enclosed mail receptacle including a door; an illumination source; and, a switch to light the illumination source, the switch operating in an off state and an on state.

Preferably, the switch is a magnetic switch.

In a preferred embodiment, a magnet moves between a first position and a second position so as to determine the state of the magnetic switch.

In a preferred embodiment, the internally lighted mailbox employs a magnetic switch which functions in a normally closed mode. Alternatively, it can employ a magnetic switch which functions in a normally open mode.

Preferably, the magnet is mounted to the door of the mailbox. Preferably, it is disposed, when the door is in a substantially closed position, so as to be in effective proximity to the magnetic switch, rendering the magnetic switch in the off state. Alternatively, it can be disposed, when the door is in a substantially open position, so as to be in effective proximity to the magnetic switch, rendering the magnetic switch in the on state.

In a preferred embodiment, an internally lighted mailbox comprises a mail receptacle including a door which is movable between a first position and a second position, the door providing access to the interior of the mail receptacle when moved into the first position; and, an illumination source. A magnetic switch operates in a first state and a second state, the magnetic switch lighting the illumination source when in the first state. A magnet is affixed to the door, the magnet rendering the magnetic switch in the first state when the door is moved in the first position.

Other features and advantages of the present invention will become apparent from the following description of the invention which refers to the accompanying drawings.

BRIEF DESCRIPTION OF THE DRAWINGS

For the purpose of illustrating the invention, there is shown in the drawings an embodiment which is presently preferred; it being understood, however, that the invention is not limited to the precise arrangements and instrumentalities shown.

DETAILED DESCRIPTION OF THE PREFERRED EMBODIMENT

Figure 1:
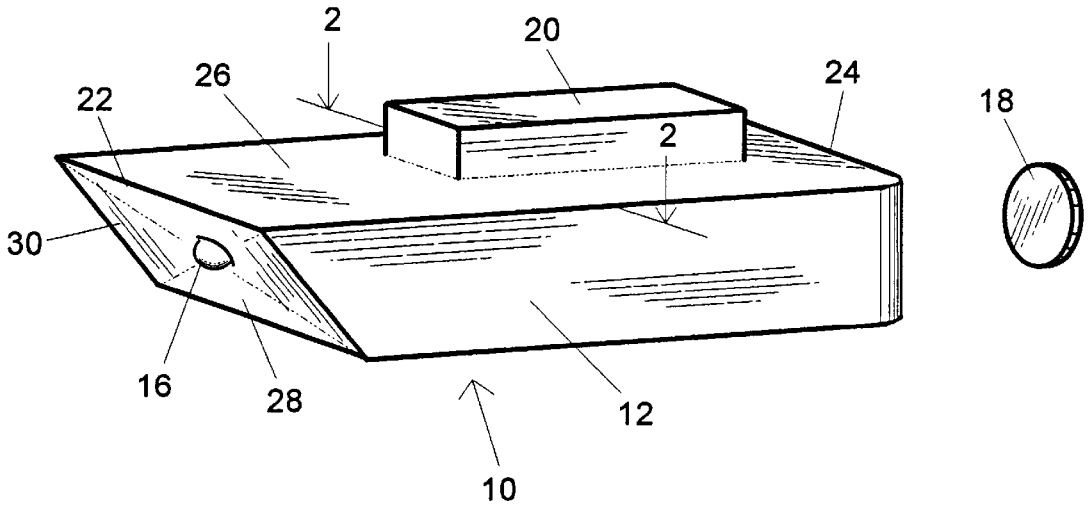
FIG. 1 is a perspective view of the interior mailbox light of the present invention.
Figure 2:
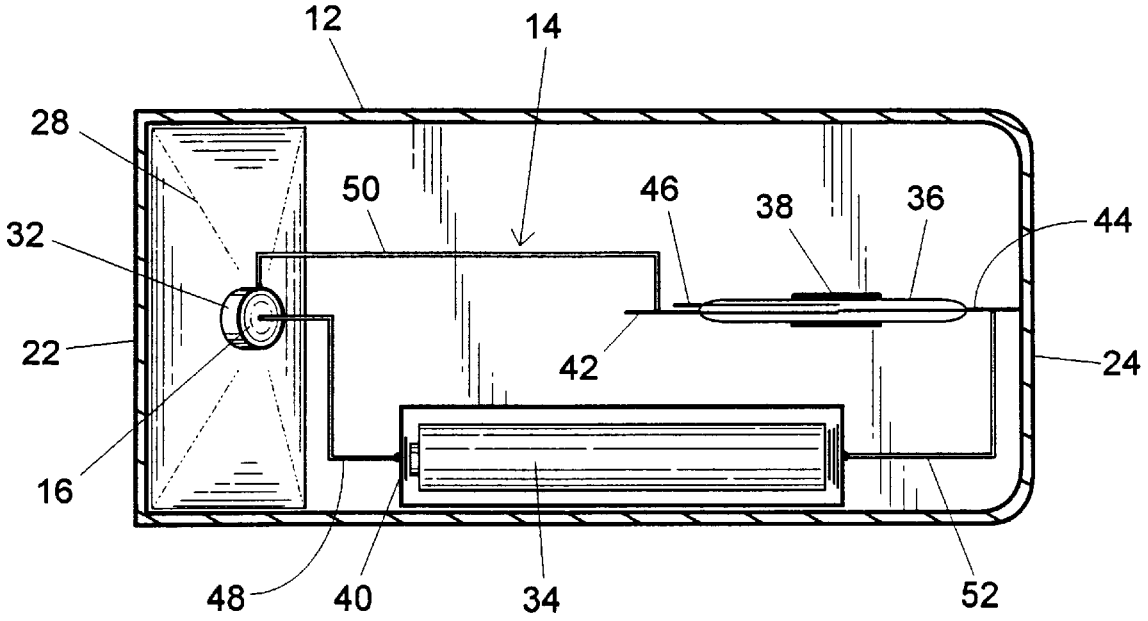
FIG. 2 is a sectional view of the inside of the housing portion of the interior mailbox light of FIG. 1 taken across line 2—2 of FIG. 1.

Referring now to the drawings wherein like numerals indicate like elements, there is shown in FIGS. 1, 2 the interior mailbox light 10 of the present invention. The mailbox light 10 is comprised of a housing 12 containing a circuit 14 for illuminating a bulb 16. A magnet 18 switches the illumination circuit 14 on and off. A mount 20 affixes the housing 12 to the inside of a mailbox, FIG. 3.

The housing 12 includes a front angled portion 22, a rear portion 24, and a top portion 26 from which the mount 20 extends. The front portion 22 is designed to face into the mailbox, FIG. 3, and includes the bulb 16, a reflector 28, and a clear lens 30. The bulb is retained in a socket 32.

The reflector 28 serves to enhance the effectiveness of the bulb 16. The lens 30 serves to protect the bulb 16 and can additionally function to focus the light from the bulb 16.

The bulb 16 is preferably a standard 1.5 volt high brightness lamp (i.e. krypton), although any low voltage incandescent lamp, light emitting diode, or the like would be satisfactory.

In addition to the bulb 16, the illumination circuit 14 includes a power supply 34, and a magnetic switch 36 to control the flow of current to the bulb 16. The magnetic switch 36 is held in place by a mount 38.

The power supply 34 resides in a battery case 40. Preferably the power supply 34 is a 1.5 volt alkaline battery, although it could, for example, be a rechargeable battery, or the like, that works in conjunction with a solar cell.

The magnetic switch 36 is preferably a "C form" magnetic reed switch which has three contacts, a normally closed contact 42, a common contact 44, and a normally open contact 46. It can therefore operate in two modes, a normally closed mode, wherein the switch is "on" in the absence of a magnetic field, and a normally open mode wherein the switch is "off" in the absence of a magnetic field. In the preferred embodiment, the magnetic switch 36 operates in the normally closed mode and therefore the normally open contact 46 is not employed.

It should be realized, however, by those skilled in the art that it is possible to construct the device so as to employ the normally open mode by using the normally open contact 46 of the magnetic switch 36.

In the illumination circuit 14, one contact of the bulb socket 32 is connected by a wire 48 to one terminal of the battery case 40. The other contact of the bulb socket 32 is connected to the normally closed contact 42 of the magnetic switch 36 by a wire 50. On the opposite side of the magnetic switch 36, the common contact 44 is connected by a wire 52 to the other terminal of the battery case 40. An electrical circuit is thus completed between the power supply 34, the bulb 16 and the magnetic switch 36. Because the illumination circuit 14 employs the normally closed contact 42 of the magnetic switch 36, power flows through the circuit in the absence of a magnetic field, thus illuminating the bulb 16. Conversely, the presence of a magnetic field will turn the illumination circuit 14 off.

Figure 3:
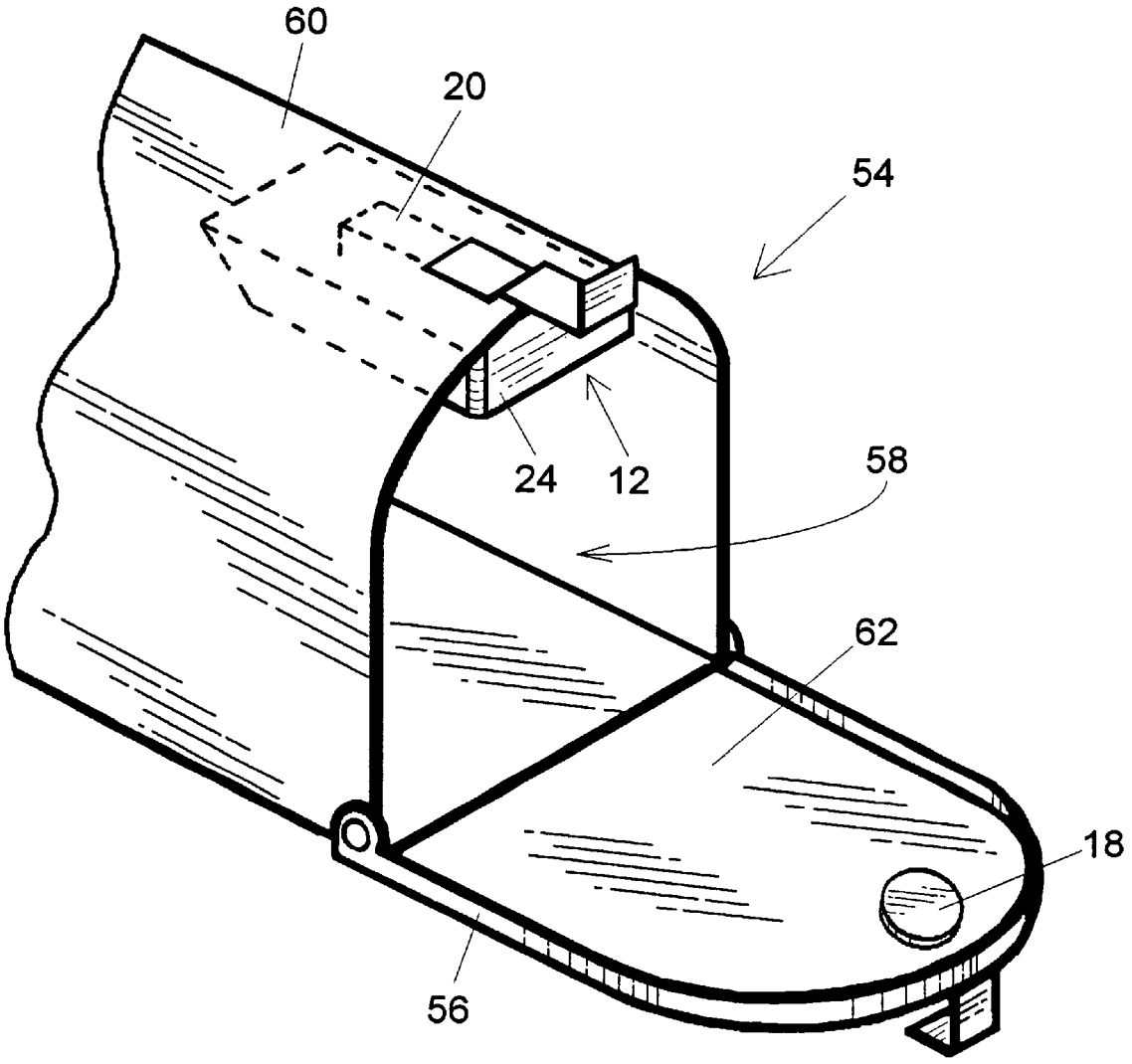
FIG. 3 shows the positioning of the interior mailbox light of the present invention as employed in a typical rural mailbox.

FIG. 3 illustrates the interior mailbox light 10 as installed in a typical metal mailbox 54 having a hinged door 56 that provides access to the interior 58. The rear portion 24 of the housing 12 faces towards the door 56 of the mailbox 54.

The housing 12 is attached to the inside surface of the top portion 60 of the mailbox 54 by the mount 20. Preferably, the mount 20 is magnetic and can therefore easily attach to the inside roof of any standard U.S. Postal approved metal mailbox. However, it should be realized by those skilled in the art that the present invention is not limited to the use of a magnetically detachable mount 20. Indeed, the housing 12 can be detachably mounted using various mechanical snapping or sliding means, or the like. Furthermore, although most standard U.S. mailboxes are made from ferrous metal, there are some made from plastic or other non-magnetic material. In such cases it may be desirable to use an adhesive medium to attach the present invention to the interior portion 58 of the mailbox 54. Indeed, a combination of means can be employed. For example, a small steel plate with an adhesive tape on one side can be mounted to the inside roof of a plastic mailbox thereby allowing the device as described to be magnetically and detachably mounted therein.

In the preferred embodiment, the magnet 18 mounts to the upper part of the inside surface 62 of the mailbox door 56 so as to be in substantial alignment with, and in proximity to, the rear portion 24 of the housing 12 when the door 56 is in the closed position. When used in conjunction with metal mailboxes, the magnet 18 will magnetically adhere to the door 56 of the mailbox 54. When used with a non-ferrous mailbox, an adhesive medium such as a double sided tape or a glue, or the like, can be used to affix the magnet 18 to the door 56 of the mailbox 54.

Referring now to FIGS. 2, 3 it can be seen that when the mailbox door 56 is closed, the magnetic field of the magnet 18 keeps the normally closed contact 42 of the magnetic switch 36 open and no current can flow to the bulb 16. However, as soon as the mailbox door 56 is opened, the influence of the magnetic field of the magnet 18 is removed. When this happens, the normally closed contact 42 of the magnetic switch 36 returns to its closed state thereby allowing current to flow to the bulb 16, thus illuminating the inner recesses of the mailbox 54.

One of the advantages of this design is that by using the magnetic switch 36 in place of a typical mechanical switch, it is not necessary to close the mailbox door 56 completely in order to turn off the mailbox light 10. This is significant because people are often not careful to securely close their mailboxes after retrieving the mail. If a mechanical switch were to be employed, a mailbox door that is left ajar could result in the prompt draining of the power supply. By employing a suitably sensitive magnetic switch 36 and an suitably strong magnet 18, the illumination circuit 14 can be designed to switch off when the magnet 18 is at a distance of several inches from the rear portion 24 of the housing 12.

It should be realized by those skilled in the art that the present invention is not limited to the use of a magnetic switch and that a mechanical switch, such as a momentary type on/off switch, or the like, can be employed. In addition, it should be understood that the present invention is not limited to the use of a normally closed magnetic reed switch and that it is possible to employ a normally open magnetic reed switch in a manner consistent with the present invention. Further, it should be realized that the present invention is not limited to the use of a magnetic reed switch, and that, for example, a magnetic hall type sensor, or the like, can be employed.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. In a mailbox having walls that define an interior space and a door which allows access to the interior space, an apparatus for illuminating the interior space of the mailbox, the apparatus comprising:

a housing having a mount affixing the housing to the interior of the mailbox, contained in the housing an illumination source to light the interior of the mailbox;

a magnetic switch in operative engagement with the illumination source to light the illumination source, the switch operating in an off state and an on state; and a magnet, affixed to the door, of the mailbox which moves between a first position and a second position so as to determine the state of the magnetic switch.

2. The apparatus of claim 1, wherein the mount is detachable.

3. The apparatus of claim 2, wherein the mount is magnetically detachable.

4. The apparatus of claim 1, wherein the housing includes a reflector to reflect the light from the illumination source.

5. The apparatus of claim 1, wherein the housing includes a lens to protect the illumination source.

6. The apparatus of claim 1, wherein the housing includes a lens to focus the light from the illumination source.

7. The apparatus of claim 1, wherein the magnet is mounted to the door of the mailbox and disposed, when the door is in a substantially closed position, so as to sufficiently proximate to the magnetic switch, to render the magnetic switch in the off state.

8. The apparatus of claim 7, wherein the magnet is mounted to the door of the mailbox and disposed, when the door is in a substantially opened position, so as to be in sufficiently distant from the magnetic switch, to render the magnetic switch in the on state.

9. The apparatus of claim 1, wherein the magnet is mounted to the door of the mailbox and disposed, when the door is in a substantially closed position, so as to be sufficiently distant from the magnetic switch, to render the magnetic switch in the off state.

10. The apparatus of claim 9, wherein the magnet is mounted to the door of the mailbox and disposed, when the door is in a substantially opened position, so as to be sufficiently proximate to the magnetic switch, to render the magnetic switch in the on state.

11. An internally lighted mailbox comprising:

a mail receptacle having walls that define an interior space and a door, connected to the mail receptacle which allows access to the interior space;

an illumination source contained in a housing having a mount affixed to the interior of the mail receptacle to light the interior of the mail receptacle;

a magnetic switch in operative engagement with the illumination source to light the illumination source, the switch operating in an off state and an on state; and a magnet, affixed to the door, which moves between a first position and a second position so as to determine the state of the magnetic switch.

12. The internally lighted mailbox of claim 11, wherein the magnet is mounted to the door of the mailbox and disposed, when the door is in a substantially closed position, so as to be sufficiently proximate to the magnetic switch, to render the magnetic switch in the off state.

13. The internally lighted mailbox of claim 12, wherein the magnet is mounted to the door of the mailbox and disposed, when the door is in a substantially opened position, so as to be in sufficiently distant from the magnetic switch, to render the magnetic switch in the on state.

14. The internally lighted mailbox of claim 11, wherein the magnet is mounted to the door of the mailbox and disposed, when the door is in a substantially closed position, so as to be sufficiently distant from the magnetic switch, to render the magnetic switch in the off state.

15. The internally lighted mailbox of claim 14, wherein the magnet is mounted to the door of the mailbox and disposed, when the door is in a substantially opened position, so as to be sufficiently proximate to the magnetic switch, to render the magnetic switch in the on state.

16. The apparatus of claim 11, wherein the housing includes a reflector to reflect the light from the illumination source.

17. The apparatus of claim 11, wherein the housing includes a lens to protect the illumination source.

18. The apparatus of claim 11, wherein the housing includes a lens to focus the light from the illumination source.

19. An internally lighted mailbox comprising:

a mail receptacle having walls that define an interior space, said mail receptacle including a door connected to the mail receptacle movable between a first position and a second position, the door providing access to the interior of the mail receptacle when moved into the first position;

an illumination source contained in a housing having a mount affixed to the interior of the mail receptacle to light the interior of the mail receptacle;

a magnetic switch in operative engagement with the illumination source, the switch operating in a first state and a second state, the magnetic switch lighting the illumination source when in the first state; and a magnet affixed to the door, the magnet rendering the magnetic switch in the first state when the door is moved in the first position.

* * * * *